US012110772B1

(12) United States Patent
Alyousef et al.

(10) Patent No.: US 12,110,772 B1
(45) Date of Patent: Oct. 8, 2024

(54) IN-RESERVOIR CARBON DIOXIDE RELEASE FOR ENHANCED HYDROCARBON RECOVERY

(71) Applicant: SAUDI ARABIAN OIL COMPANY, Dhahran (SA)

(72) Inventors: Zuhair Alyousef, Dhahran (SA); Hamoud Alqahtani, Dhahran (SA); Subhash C. Ayirala, Dhahran (SA); Muhammad M. Almajid, Dhahran (SA); Ali A. Al-Taq, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/315,262

(22) Filed: May 10, 2023

(51) Int. Cl.
*E21B 43/16* (2006.01)
*E21B 43/24* (2006.01)

(52) U.S. Cl.
CPC ..... *E21B 43/164* (2013.01); *E21B 43/24* (2013.01)

(58) Field of Classification Search
CPC ..... E21B 43/164; E21B 43/24
See application file for complete search history.

(56) References Cited

U.S. PATENT DOCUMENTS

| | | | | |
|---|---|---|---|---|
| 10,494,566 | B2 | 12/2019 | Al-Nakhli et al. | |
| 10,648,305 | B2 | 5/2020 | Ayirala et al. | |
| 10,889,751 | B2 | 1/2021 | Shahin et al. | |
| 2010/0258309 | A1 * | 10/2010 | Ayodele ..... | E21B 43/243 166/272.3 |

(Continued)

FOREIGN PATENT DOCUMENTS

CN 100430455 C 11/2008

OTHER PUBLICATIONS

Peksa, Anna E., Wolf, Karl-Heinz A., and Pacelli L. Zitha. "Molecular Diffusion of CO2 From Carbonated Water (CW) Into the Oil—Experimental Observations." Paper presented at the SPE Asia Pacific Oil and Gas Conference and Exhibition, Jakarta, Indonesia, Oct. 2013. doi: https://doi.org/10.2118/165902-MS.

(Continued)

*Primary Examiner* — Silvana C Runyan

(74) *Attorney, Agent, or Firm* — Vorys, Sater, Seymour and Pease LLP

(57) ABSTRACT

Enhanced hydrocarbon recovery methods may include use of carbonated aqueous fluids. Methods for enhanced hydrocarbon recovery may include: introducing a carbonated aqueous fluid into a subterranean reservoir, the carbonated aqueous fluid including carbon dioxide; introducing a first salt solution and a second salt solution into the subterranean reservoir after introducing the carbonated aqueous fluid; contacting the first salt solution with the second salt solution in the subterranean reservoir under conditions where the first salt and the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

23 Claims, 4 Drawing Sheets

(56) References Cited

U.S. PATENT DOCUMENTS

| | | | | |
|---|---|---|---|---|
| 2014/0144632 | A1* | 5/2014 | Zavolzhski | C09K 8/592 166/280.2 |
| 2015/0337638 | A1* | 11/2015 | Lawrence | C09K 8/80 166/300 |
| 2019/0376374 | A1* | 12/2019 | Ayirala | E21B 43/164 |
| 2020/0355051 | A1 | 11/2020 | Al-Nakhli | |
| 2020/0355052 | A1* | 11/2020 | Al-Nakhli | E21B 43/00 |
| 2021/0380869 | A1 | 12/2021 | Al-Taq et al. | |

OTHER PUBLICATIONS

Zou, Jiandong, Liao, Xinwei, Zhao, Xiaoliang, Chen, Zhiming, Mu, Lingyu, Chu, Hongyang, Wu, Jiaqi, and Zhen Zhang. "An Experimental Study of the Dynamic Mass Transfer Process During Carbonated Water Injection." Paper presented at the International Petroleum Technology Conference, Beijing, China, Mar. 2019. doi: https://doi.org/10.2523/IPTC-19048-MS.

Nguyen, D. A., Iwaniw, M. A., Fogler, H. S.: "Kinetics and mechanism of the reaction between ammonium and nitrite ions: experimental and theoretical studies," Chemical Engineering Science 58 (2003) 4351-4362.

* cited by examiner

IN-RESERVOIR CARBON DIOXIDE RELEASE FOR ENHANCED HYDROCARBON RECOVERY

FIELD OF THE DISCLOSURE

The present disclosure relates generally to methods and systems for enhanced hydrocarbon recovery and, more particularly, enhanced hydrocarbon recovery methods and systems utilizing carbon dioxide.

BACKGROUND OF THE DISCLOSURE

Enhanced hydrocarbon recovery (e.g., enhanced oil recovery, EOR) refers to methods and systems that inject fluids through an injection well to a downhole location to encourage release of the hydrocarbons within a reservoir and mobilization of the hydrocarbons toward a production well. The injected fluids may promote release and mobilization of hydrocarbons through a variety of mechanisms including oil swelling, viscosity reduction, and wettability alteration, for example.

One particularly attractive enhanced hydrocarbon recovery technique is carbon dioxide injection. Carbon dioxide may promote release of hydrocarbons from a subterranean reservoir to improve hydrocarbon production by reducing the hydrocarbon viscosity and pushing the hydrocarbons toward a production well. Carbon dioxide for injection can be obtained in a cost-effective manner in comparison to alternative gases and injection fluids. Moreover, downhole injection of carbon dioxide also offers a potential avenue for underground sequestration of this greenhouse gas.

One technique for utilizing carbon dioxide, in advanced hydrocarbon recovery techniques, may involve injection of carbonated water or a similar carbonated aqueous fluid. Carbonated water injection may facilitate a hybrid approach for advanced hydrocarbon recovery, taking advantage of aspects of both water flooding and carbon dioxide injection, thereby allowing the carbon dioxide to diffuse into both hydrocarbons and water to mobilize hydrocarbons for removal via a production well.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

A first nonlimiting method of the present disclosure includes: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid; contacting the first salt solution with the second salt solution in the subterranean reservoir under conditions where the first salt and the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

A second nonlimiting method of the present disclosure includes: introducing a carbonated aqueous fluid into a subterranean reservoir, the carbonated aqueous fluid comprising carbon dioxide dissolved in an aqueous fluid; introducing a first salt and a second salt into the subterranean reservoir; contacting the first salt with the second salt within the carbonated aqueous fluid in the subterranean reservoir under conditions where the first salt and the second salt undergo an exothermic reaction; heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; mobilizing hydrocarbons in the upper portion of the subterranean reservoir toward a production well with the carbon dioxide that migrates to the upper portion of the subterranean reservoir; wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

A third nonlimiting method of the present disclosure includes: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid, the first salt comprising a nitrite anion and the second salt comprising an ammonium cation; contacting the first salt solution with the second salt solution in the subterranean reservoir under conditions where the nitrite anion of the first salt and the ammonium cation of the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; wherein the decarbonated saline solution has a lower density than the carbonated aqueous fluid.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
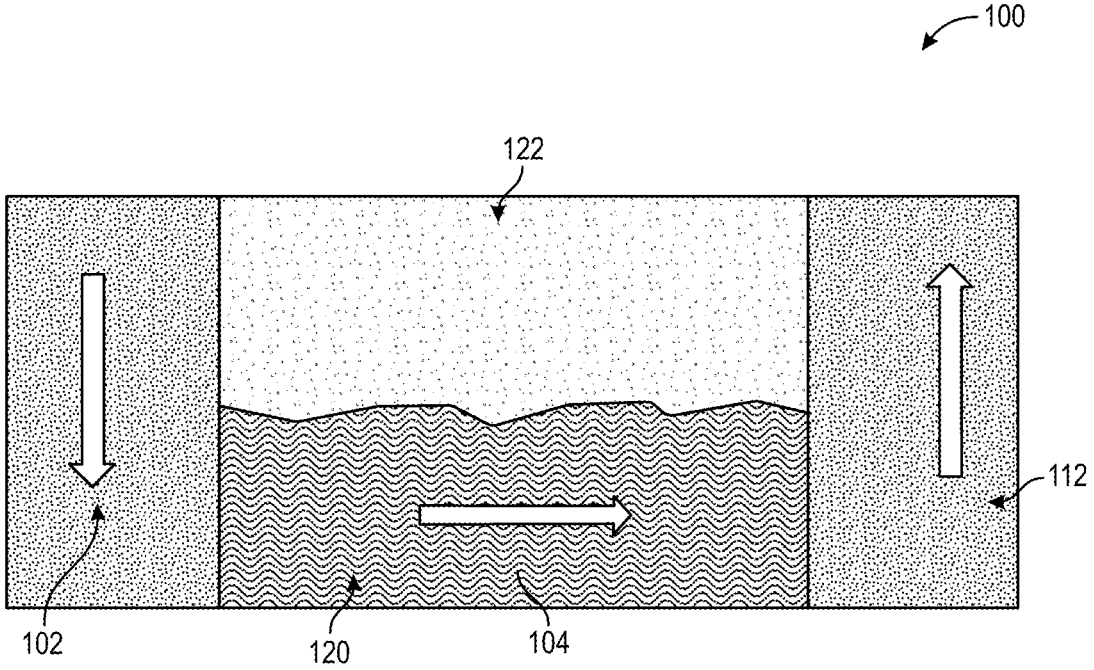
FIG. 1 is a diagram of a non-limiting subterranean reservoir with an aqueous flooding fluid introduced.

Embodiments in accordance with the present disclosure generally relate to methods and systems for enhanced hydrocarbon recovery and, more particularly, enhanced hydrocarbon recovery methods and systems utilizing carbon dioxide.

There is increasing interest in systems and methods for introduction of carbon dioxide to subterranean reservoirs to promote enhanced hydrocarbon recovery, such as through introduction of carbonated aqueous fluids and release of carbon dioxide therefrom to promote hydrocarbon mobilization. Carbon dioxide introduction to a subterranean reservoir within a carbonated aqueous fluid may promote enhanced hydrocarbon recovery with increased efficiency and more effective zonal mobilization of hydrocarbons within the subterranean reservoir, as compared to processes introducing gaseous or supercritical carbon dioxide, or other alternative fluids for encouraging hydrocarbon mobilization. Increased hydrocarbon production and low operating costs may improve profit margin compared to alternative enhanced hydrocarbon recovery techniques.

The solubility of carbon dioxide in carbonated aqueous fluids may decrease with increasing temperature and increase with increasing pressure. In the present disclosure, an exothermic reaction between two salts may promote release of carbon dioxide from a carbonated aqueous fluid at a desired time or location in response to a temperature increase to facilitate hydrocarbon mobilization. In addition to controlling timing of the carbon dioxide release, promoting release of the carbon dioxide by an exothermic reaction between the two salts may provide several advantages with respect to enhanced hydrocarbon recovery. Since the density of carbon dioxide is less than that of aqueous fluids, the carbon dioxide rises in the subterranean reservoir and promotes hydrocarbon mobilization in an upper portion of the subterranean reservoir. Moreover, a decarbonated saline solution, which is more dense than carbon dioxide and less dense than the carbonated aqueous fluid, may be located in a middle portion of the subterranean reservoir and promote hydrocarbon mobilization therein. The decarbonated saline solution may be obtained from the carbonated aqueous fluid following carbon dioxide release in the presence of the two salts. Finally, the remaining carbonated aqueous fluid, the most dense of the three fluids, may promote hydrocarbon mobilization within a lower portion of the subterranean reservoir. Thus, the present disclosure may promote hydrocarbon mobilization over at least three regions (portions) of a subterranean reservoir with good zonal distribution, which may lead to more efficient or complete hydrocarbon mobilization and subsequent production.

The present disclosure provides methods and systems that may improve the efficiency of enhanced hydrocarbon recovery processes in which a carbonated aqueous fluid is injected into a subterranean reservoir. Following optional but preferable introduction of an aqueous flooding fluid to a subterranean reservoir, a carbonated aqueous fluid comprising carbon dioxide dissolved in an aqueous fluid may be introduced to the subterranean reservoir to promote hydrocarbon mobilization within at least a portion of the subterranean reservoir. The carbon dioxide within at least a portion of the carbonated aqueous fluid may be released through an exothermic reaction between two salts separately introduced to the carbonated aqueous fluid within the subterranean reservoir, such as through introduction of a first salt solution containing a first salt and a second salt solution containing a second salt different than the first salt. Carbon dioxide released from the carbonated aqueous fluid and a decarbonated saline solution formed following release of carbon dioxide may promote improved zonal mobilization of hydrocarbons within the subterranean reservoir to facilitate increased production of the hydrocarbons, as discussed in more detail hereinafter.

Conventional enhanced hydrocarbon recovery operations may introduce an aqueous flooding fluid to a subterranean reservoir. The aqueous flooding fluid may leave hydrocarbons within the upper portions of the subterranean reservoir unmobilized, since the aqueous flooding fluid resides primarily in the lower portion of the subterranean reservoir. FIG. 1 is a diagram of a non-limiting subterranean reservoir with an aqueous flooding fluid introduced. As shown, subterranean reservoir 100 includes injection well region 102 and production well region 112. Aqueous flooding fluid 104 is introduced to subterranean reservoir 100 via injection well region 102 and occupies lower portion 120 of subterranean reservoir 100. Aqueous flooding fluid 104 moves toward production well region 112, and in doing so mobilizes hydrocarbons contained within lower portion 120. Because aqueous flooding fluid 104 remains confined within lower portion 120, hydrocarbons within upper portion 122 of subterranean reservoir 100 remain entrapped and do not effectively migrate toward production well region 112. Block arrows in FIG. 1 show the general direction of fluid migration in subterranean reservoir 100.

Elements of the drawings having a similar structure and function in multiple figures utilize in-common reference characters herein, and such elements will only be described in detail at their first occurrence in the interest of brevity.

Figure 2:
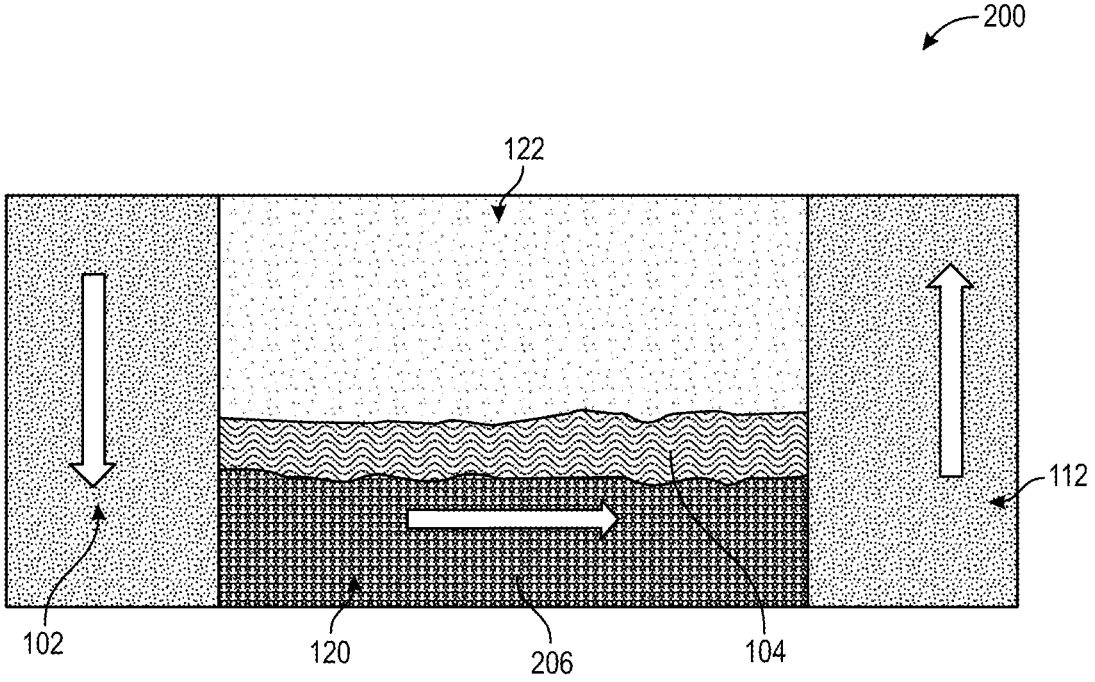
FIG. 2 is a diagram of a non-limiting subterranean reservoir with an aqueous flooding fluid and carbonated aqueous fluid introduced.

A carbonated aqueous fluid may be introduced to a subterranean reservoir in addition to an aqueous flooding fluid. FIG. 2 is an illustration of a non-limiting example subterranean reservoir with an aqueous flooding fluid and carbonated aqueous fluid introduced. Subterranean reservoir 200 includes injection well region 102 through which aqueous flooding fluid 104 and carbonated aqueous fluid 206 are introduced. Since carbonated aqueous fluid 206 is more dense than aqueous flooding fluid 104, carbonated aqueous fluid 206 resides below aqueous flooding fluid 104 within subterranean reservoir 200. Lower portion 120 of the subterranean reservoir 200 contains predominantly carbonated aqueous fluid 206 in view of the greater density.

Carbon dioxide may be introduced to an aqueous fluid to form a carbonated aqueous fluid using any suitable means. The aqueous fluid may be obtained from any suitable source such as, but not limited to, fresh water (e.g., stream water, lake water, or municipal treated water), non-potable water such as gray water or industrial process water, sea water, brine, aqueous salt solutions, partially desalinated water, produced water (including brine and other salt water solutions), or any combination thereof. Produced water may comprise formation water or flowback water produced from a nearby well, for example. The carbon dioxide may be injected into the aqueous fluid prior to introducing the carbonated aqueous fluid into the subterranean reservoir. Alternately, the carbon dioxide may be injected to an aqueous fluid while the aqueous fluid is being introduced to the subterranean reservoir. The carbonated aqueous fluid may have a carbon dioxide concentration ranging from about 10 ppm to saturated, or about 100 ppm to saturated, or about 10 ppm to about 1000 ppm, or about 10 ppm to about 5000 ppm, or about 10 ppm to about 10,000 ppm, or even greater than 10,000 ppm. Preferably, the carbonated aqueous fluid may be saturated in carbon dioxide prior to introduction to the subterranean reservoir, which may minimize water usage. "Saturated," as used herein, refers to the concentration of solute (e.g., carbon dioxide) in a solution (e.g., an aqueous fluid) in which the maximum possible amount of solute is dissolved at a given pressure and temperature (e.g., atmospheric pressure and ambient temperature, a temperature and pressure used in the enhanced hydrocarbon recovery operation, or a temperature and pressure of the carbonated aqueous fluid at surface conditions before injection downhole). Additional dissolved gases (e.g., nitrogen) may be present in the carbonated aqueous fluid in addition to carbon dioxide. The carbon dioxide may originate from any suitable source including, for example, a carbon dioxide deposit, a pressurized storage tank or cylinder, a chemical reaction, and the like, or any combination thereof. The carbonated aqueous fluid may subsequently be introduced to the subterranean reservoir at any temperature below which the exothermic reaction does not occur, and such as a temperature ranging from about 1° C. to about 60° C., or about 5° C. to about 60° C., or about 10° C. to about 60° C., or about 20° C. to about 60° C., or about 30° C. to about 60° C. and at any suitable reservoir pressure, such as a pressure from about 100 psi to about 10,000 psi, or about 100 psi to about 5,000 psi, or about 100 psi to about 2,500 psi.

In the present disclosure, two salts capable of undergoing an exothermic reaction under specified conditions may be utilized to promote carbon dioxide release within the subterranean reservoir. The first salt and the second salt may be present in a first salt solution and a second salt solution, respectively, preferably a first aqueous salt solution and a second aqueous salt solution. The aqueous fluids within the first and second aqueous salt solutions may be obtained from any suitable source, as discussed above in reference to the carbonated aqueous fluid above, provided that the first salt and/or the second salt are not incompatible with any components within the aqueous fluid.

The first salt solution and second salt solution may comprise any suitable combination of salts that may produce an exothermic reaction under specified conditions upon being combined together in the carbonated aqueous fluid within the subterranean reservoir. In more specific examples, the first salt may comprise a nitrite salt, such as sodium nitrite or other alkali metal nitrite, and the second salt may comprise an ammonium salt, such as ammonium chloride or other ammonium halide. The first salt solution and the second salt solution each have a salt concentration sufficient to generate a sufficient exothermic reaction when the first salt solution and the second salt solution are introduced to the subterranean reservoir. For example, salt concentrations for the first salt solution and the second salt solution may range from about 100 ppm to about 1000 ppm, or about 100 ppm to about 5000 ppm, or about 100 ppm to about 10,000 ppm, or even greater than 10,000 ppm. The concentration of the first salt solution and the second salt solution may be the same or may differ. Similarly, the volume of the first salt solution and the second salt solution introduced to the subterranean reservoir may be the same or differ. By varying the concentration and amounts of the first and second salt solutions, the amount of heat released in the exothermic reaction may be varied. It is expected that the first salt solution and the second salt solution may be introduced to the subterranean reservoir under similar conditions to one another, as well as under conditions similar to those at which the carbonated aqueous fluid is introduced.

To limit the possibility of the exothermic reaction taking place before reaching the carbonated aqueous fluid within the subterranean reservoir, the first salt solution and the second salt solution may each be introduced separately to the carbonated aqueous fluid within the subterranean reservoir. For example, separate pipes (lines) may carry the first and second salt solutions to the lower portion of the subterranean reservoir for disposition in the carbonated aqueous fluid. In another example, one of the salt solutions may be introduced to the subterranean reservoir within coiled tubing within the injection well, and the other of the salt solutions may be carried within an annulus between the coiled tubing and the well casing. It is also envisioned that one of the first salt or the second salt may alternately be present in the carbonated aqueous fluid prior to introduction of the carbonated aqueous fluid into the subterranean reservoir, in which case the other salt may be introduced as a separate salt solution. If present in the carbonated aqueous fluid, preferably the second salt (ammonium salt) may be delivered to the subterranean reservoir in the carbonated aqueous fluid.

Once in the subterranean reservoir, the first salt solution and the second salt solution may contact each other within the carbonated aqueous fluid so that the first and second salts undergo the exothermic reaction under specified conditions. In the case of sodium nitrite and ammonium chloride, the exothermic reaction occurs as shown in Reaction 1 below:

$$NaNO_2+NH_4Cl \rightarrow NaCl+H_2O+N_2 \qquad \text{Reaction 1}$$

Figure 3:
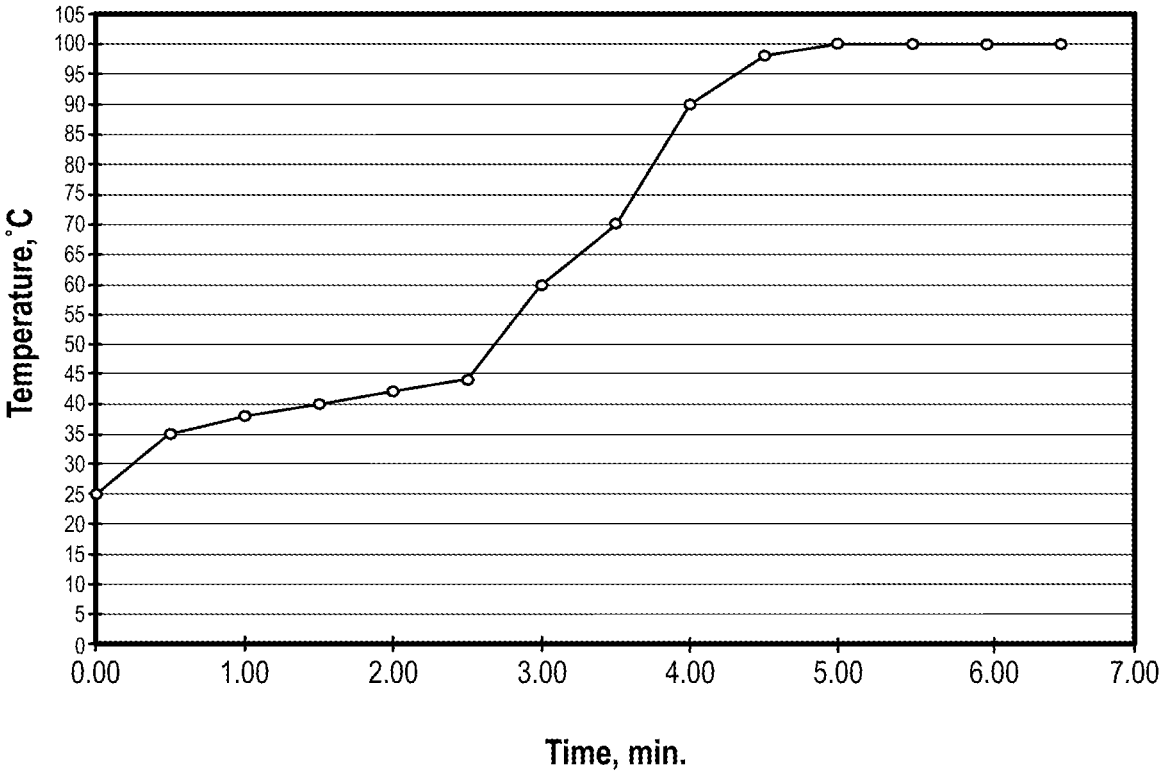
FIG. 3 is an example graph showing the temperature increase occurring during an exothermic reaction of sodium nitrite and ammonium chloride.

The term "exothermic" and grammatical variants thereof refers to a chemical reaction which generates thermal energy (e.g., heat) and may be defined as a reaction having an enthalpy of reaction ($\Delta H$) less than zero. In the case of the exothermic reaction between sodium nitrite and ammonium chloride, the enthalpy of reaction is $-79.95$ kcal $mol^{-1}$. FIG. 3 is an example graph showing the temperature increase occurring during an exothermic reaction of sodium nitrite and ammonium chloride. The reaction is promoted using acetic acid as a catalyst. As shown, after starting from room temperature (25° C.), the temperature slowly increased to 45° C. over about 2.5 minutes before rapidly increasing to about 100° C. and stabilizing at this temperature within about 5 minutes of total reaction.

The exothermic reaction may occur at a specified temperature, preferably a temperature greater than 60° C., or greater than 70° C., or from 50° C. to 70° C., for example. Heating of the first salt solution and/or the second salt solution may take place using the latent heat present within the subterranean reservoir (e.g., upon mixing with the carbonated aqueous fluid and reaching an equilibrium temperature). Alternately, at least one of the first salt solution or the second salt solution may be heated prior to or concurrently with introduction of the salt solution(s) to the subterranean reservoir.

Alternately or additionally, the exothermic reaction may be catalyzed by an acid, such as at a pH of about 5 or less. An acid may be introduced into the carbonated aqueous fluid or be present in one of the salt solutions to catalyze the reaction. When the first salt contains a nitrite anion and the second salt contains an ammonium cation, the acid may be introduced to the second salt solution containing the ammonium cation. Nitrite anions may be unstable to acid and form nitrous acid in the presence of a sufficiently strong acid. Hence, nitrite ions may be kept separate from the acid until the acid is needed to promote the exothermic reaction according to the disclosure herein. Alternately, the acid may be introduced to the carbonated aqueous fluid as an acid solution introduced separately to the subterranean reservoir. The acid may be an inorganic acid (e.g., hydrochloric acid or hydrobromic acid), an organic acid, or any suitable combination thereof. Preferably, the acid may be an organic acid such as formic acid, acetic acid, propionic acid, methanesulfonic acid, chloroacetic acid, trifluoroacetic acid, the like, or any combination thereof.

The exothermic reaction of the first salt and the second salt may release carbon dioxide from the carbonated aqueous fluid to the subterranean reservoir as a result of the generated heat increasing the temperature of the carbonated aqueous fluid. In addition to the carbon dioxide released from the carbonated aqueous fluid, the exothermic reaction may release further gases into the subterranean reservoir, which may also contribute to the mobilization of hydrocarbons therein. For example, the reaction between a nitrite salt and an ammonium salt may generate nitrogen gas in addition to providing heat for promoting release of at least a portion of the carbon dioxide from the carbonated aqueous fluid.

Carbon dioxide released from the carbonated aqueous fluid may mobilize hydrocarbons elsewhere within the subterranean reservoir, such as an upper portion of the subterranean reservoir where the less-dense carbon dioxide migrates. In addition, the portion of the carbonated aqueous fluid from which the carbon dioxide is released may contain salts originating from the exothermic reaction between the first salt and the second salt (e.g., NaCl in the case of the exothermic reaction between sodium nitrite and ammonium chloride), wherein a decarbonated saline solution is obtained following release of the carbon dioxide. The decarbonated saline solution may have a density intermediate between that of the carbon dioxide and the portion of the carbonated aqueous fluid that has not been decarbonated. The carbonated aqueous fluid, the decarbonated saline solution, and the carbon dioxide may promote hydrocarbon mobilization toward a production well in different portions (depths) of the subterranean reservoir. In non-limiting examples, mobilization of hydrocarbons may occur through reduction in hydrocarbon viscosity and may additionally occur through physical stimulation (toward a production well) of hydrocarbons at varying depths of the subterranean reservoir. The carbonated aqueous fluid, the decarbonated saline solution, and the carbon dioxide may promote hydrocarbon mobilization by the same or different mechanism in each location where they are present. The decarbonated saline solution may have a density greater than that of the aqueous flooding fluid (if present) and the carbon dioxide, and a density lower than that of the carbonated aqueous fluid. Thus, hydrocarbons may be mobilized in an upper portion, a middle portion, and a lower portion of the subterranean reservoir with fluids of varying densities, as discussed herein.

Figure 4:
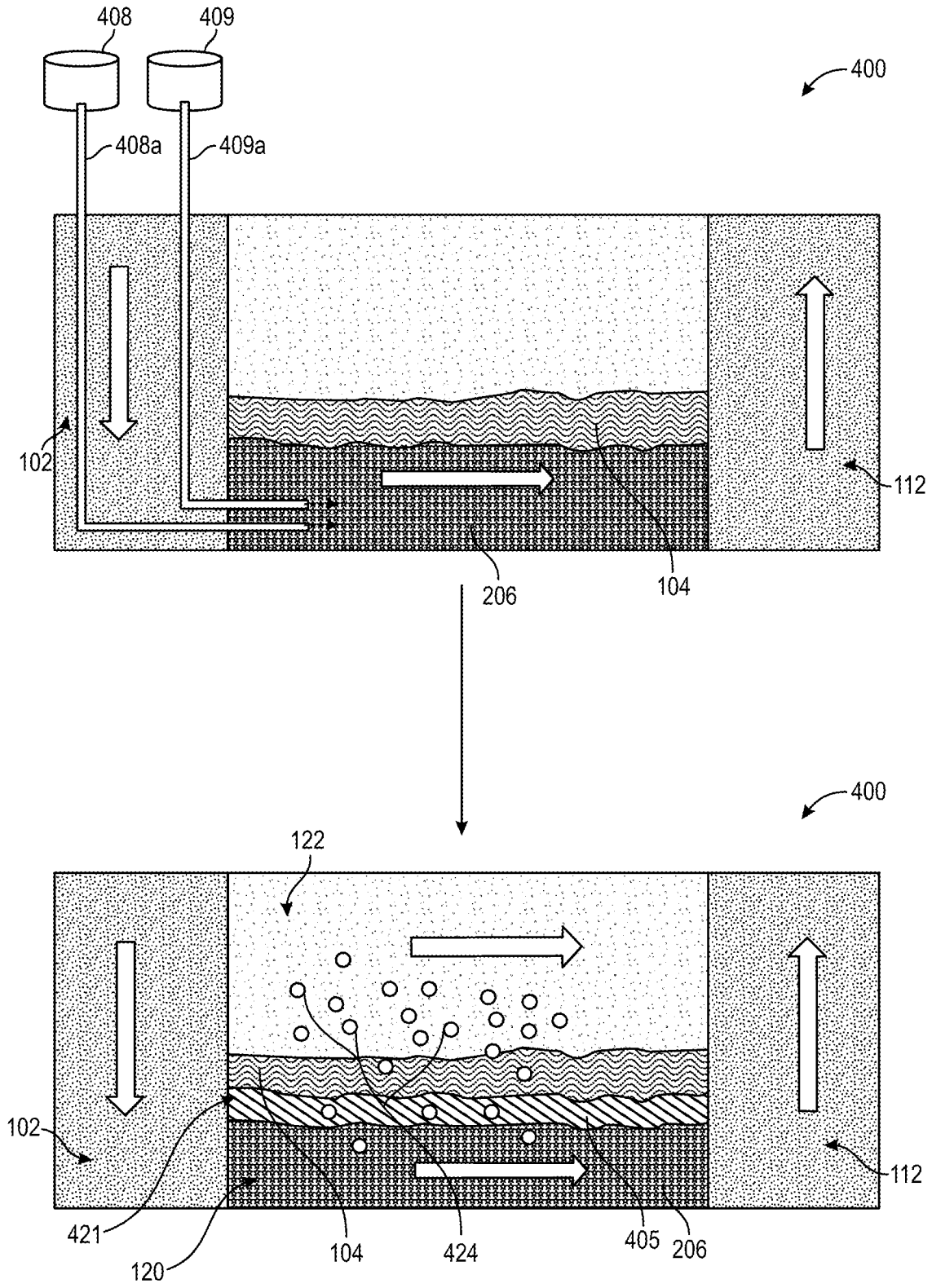
FIG. 4 is a diagram of a non-limiting subterranean reservoir with a carbonated aqueous fluid and salt solutions introduced, wherein the salt solutions promote release of carbon dioxide by an exothermic reaction.

FIG. 4 is a diagram of a non-limiting subterranean reservoir with a carbonated aqueous fluid and salt solutions introduced, wherein the salt solutions promote release of carbon dioxide. Subterranean reservoir 400 includes injection well region 102 through which (optional) aqueous flooding fluid 104 and carbonated aqueous fluid 206 are introduced to subterranean reservoir 400, in a similar manner to that described above for FIG. 2. A first salt solution from tank 408 and a second salt solution from tank 409 are introduced into carbonated aqueous fluid 206 within subterranean reservoir 400 via lines 408*a* and 409*a*, respectively, in injection well region 102. The first salt and the second salt undergo an exothermic reaction under suitable conditions in carbonated aqueous fluid 206 to release carbon dioxide 424 from a portion thereof. Suitable conditions include heating at a temperature above 60° C. and/or acid catalysis. Carbon dioxide 424 migrates from lower portion 120 through the middle portion 421 and onward to upper portion 122 of subterranean reservoir 400. Decarbonated saline solution 405 has a lower density than carbonated aqueous fluid 206 and a higher density than (optional) aqueous flooding fluid 104. Hydrocarbons may be mobilized within subterranean reservoir 400 as carbon dioxide 424 may promote mobilization of hydrocarbons in upper portion 122 toward production well 112, carbonated aqueous fluid 206 may promote mobilization of hydrocarbons in lower portion 120, and aqueous flooding fluid 104 (if present) and/or decarbonated saline solution 405 may promote mobilization of hydrocarbons in middle portion 421 of subterranean reservoir 400, as shown by the block arrows in FIG. 4.

Accordingly, in some embodiments, methods of the present disclosure may comprise: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid; contacting the first salt solution with the second salt solution in the subterranean reservoir under conditions where the first salt and the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

In some, or other, embodiments, methods of the present disclosure may comprise: introducing a carbonated aqueous fluid into a subterranean reservoir, the carbonated aqueous fluid comprising carbon dioxide dissolved in an aqueous fluid; introducing a first salt and a second salt into the subterranean reservoir; contacting the first salt with the second salt within the carbonated aqueous fluid in the subterranean reservoir under conditions where the first salt and the second salt undergo an exothermic reaction; heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; mobilizing hydrocarbons in the upper portion of the subterranean reservoir toward a production well with the carbon dioxide that migrates to the upper portion of the subterranean reservoir; wherein the decarbonated saline solution (and the aqueous flooding fluid) promote mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

In still other embodiments, methods of the present disclosure may comprise: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid, the first salt comprising a nitrite anion and the second salt comprising an ammonium cation; contacting the first salt solution with the second salt solution in the subterranean reservoir under conditions where the nitrite anion of the first salt and the ammonium cation of the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; wherein the decarbonated saline solution has a lower density than the carbonated aqueous fluid.

Optionally, any of the foregoing may further comprise introducing an aqueous flooding fluid into the subterranean reservoir prior to introducing the carbonated aqueous fluid, the carbonated aqueous fluid having a higher density than the aqueous flooding fluid.

Embodiments disclosed herein include:

A. Methods for enhanced hydrocarbon recovery, comprising: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid; contacting the first salt solution with the second salt solution in the subterranean reservoir under conditions where the first salt and the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

B. Methods for enhanced hydrocarbon recovery, comprising: introducing a carbonated aqueous fluid into a subterranean reservoir, the carbonated aqueous fluid comprising carbon dioxide dissolved in an aqueous fluid; introducing a first salt and a second salt into the subterranean reservoir; contacting the first salt with the second salt within the carbonated aqueous fluid in the subterranean reservoir under conditions where the first salt and the second salt undergo an exothermic reaction; heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; mobilizing hydrocarbons in the upper portion of the subterranean reservoir toward a production well with the carbon dioxide that migrates to the upper portion of the subterranean reservoir; wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

C. Methods for enhanced hydrocarbon recovery, comprising: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid, the first salt comprising a nitrite anion and the second salt comprising an ammonium cation; contacting the first salt solution with the second salt solution in the subterranean reservoir under conditions where the nitrite anion of the first salt and the ammonium cation of the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; wherein the decarbonated saline solution has a lower density than the carbonated aqueous fluid.

Each of embodiments A, B, and C may have one or more of the following additional elements in any combination:

Element 1: wherein the method further comprises: introducing an aqueous flooding fluid into the subterranean reservoir prior to introducing the carbonated aqueous fluid, the carbonated aqueous fluid having a higher density than the aqueous flooding fluid.

Element 2: wherein the decarbonated saline solution has a lower density than the carbonated aqueous fluid and a higher density than the aqueous flooding fluid.

Element 3: wherein the subterranean reservoir has a temperature sufficient to initiate the exothermic reaction, an acid is introduced to the subterranean reservoir to initiate the exothermic reaction, or any combination thereof.

Element 4: wherein the acid is an organic acid.

Element 5: wherein the acid is introduced to the subterranean reservoir in one of the first salt solution or the second salt solution.

Element 6: wherein the exothermic reaction occurs at a temperature of about 60° C. or greater, at a pH of about 5 or less, or any combination thereof.

Element 7: wherein the first salt comprises a nitrite anion and the second salt comprises an ammonium cation, the nitrite anion and the ammonium cation undergoing the exothermic reaction once the first salt solution and the second salt solution are contacted with one another under the conditions where the first salt and the second salt undergo the exothermic reaction.

Element 8: wherein the first salt comprises an alkali metal nitrite and the second salt comprises an ammonium halide.

Element 9: wherein first salt comprises sodium nitrite and the second salt comprises ammonium chloride.

Element 10: wherein the decarbonated saline solution has a lower density than the carbonated aqueous fluid.

Element 11: wherein the carbon dioxide promotes mobilization of hydrocarbons in the upper portion of the subterranean reservoir toward a production well, the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well, the method further comprising: producing at least a portion of each of the hydrocarbons from the production well.

Element 12: wherein the first salt is introduced to the subterranean reservoir in a first salt solution and the second salt is introduced to the subterranean reservoir in a second salt solution, the first salt solution and the second salt solution being kept separate from one another prior to contacting the first salt with the second salt within the carbonated aqueous fluid under the conditions where the first salt and the second salt undergo the exothermic reaction.

Element 13: wherein the acid is introduced to the subterranean reservoir in an aqueous solution containing one of the first salt or the second salt.

Element 14: wherein the method further comprises: mobilizing hydrocarbons in the upper portion of the subterranean reservoir toward a production well with the carbon dioxide that migrates to the upper portion of the subterranean reservoir; wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

Element 15: wherein the acid is introduced to the subterranean reservoir in the second salt solution.

Element 16: wherein the method further comprises: introducing an aqueous flooding fluid into the subterranean reservoir prior to introducing the carbonated aqueous fluid, the carbonated aqueous fluid having a higher density than the aqueous flooding fluid and the decarbonated saline solution.

By way of non-limiting example, exemplary combinations applicable to A include, but are not limited to: 1 or 1 and 2, and 3; 1 or 1 and 2, and 4; 1 or 1 and 2, and 5; 1 or 1 and 2, and 6; 1 or 1 and 2, and 7, 8 and/or 9; 1 or 1 and 2, and 10; 1 or 1 and 2, and 11; 3 and 4; 3 and 5; 3-5; 3 and 6; 3, and 7, 8 and/or 9; 3 and 10; 3 and 11; 4 and 5; 4 and 6; 4, and 7, 8 and/or 9; 4 and 10; 4 and 11; 6, and 7, 8 and/or 9; 6 and 10; 6 and 11; 7, 8 and/or 9, and 10; 7, 8 and/or 9, and 11; and 10 and 11.

By way of non-limiting example, exemplary combinations applicable to B include, but are not limited to: 1 or 1 and 2, and 3; 1 or 1 and 2, and 6; 1 or 1 and 2, and 7; 1 or 1 and 2, and 12; 1 or 1 and 2, and 13; 3 and 6; 3 and 7; 3 and 12; 3 and 13; 6 and 7; 6 and 12; 6 and 13; 7 and 12; 7 and 13; and 12 and 13.

By way of non-limiting example, exemplary combinations applicable to C include, but are not limited to: 3 and 6; 3 and 14; 3 and 15; 3 and 16; 6 and 14; 6 and 15; 6 and 16; 14 and 15; 14 and 16; and 15 and 16.

The present disclosure is further directed to the following non-limiting clauses:

Clause 1. A method comprising: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid; contacting the first salt solution with the second salt solution in the subterranean reservoir under conditions where the first salt and the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

Clause 2. The method of clause 1, further comprising: introducing an aqueous flooding fluid into the subterranean reservoir prior to introducing the carbonated aqueous fluid, the carbonated aqueous fluid having a higher density than the aqueous flooding fluid.

Clause 3. The method of clause 2, wherein the decarbonated saline solution has a lower density than the carbonated aqueous fluid and a higher density than the aqueous flooding fluid.

Clause 4. The method of any one of clauses 1-3, wherein the subterranean reservoir has a temperature sufficient to initiate the exothermic reaction, an acid is introduced to the subterranean reservoir to initiate the exothermic reaction, or any combination thereof.

Clause 5. The method of clause 4, wherein the acid is an organic acid.

Clause 6. The method of clause 4 or clause 5, wherein the acid is introduced to the subterranean reservoir in one of the first salt solution or the second salt solution.

Clause 7. The method of any one of clauses 1-6, wherein the exothermic reaction occurs at a temperature of about 60° C. or greater, at a pH of about 5 or less, or any combination thereof.

Clause 8. The method of any one of clauses 1-7, wherein the first salt comprises a nitrite anion and the second salt comprises an ammonium cation, the nitrite anion and the ammonium cation undergoing the exothermic reaction once the first salt solution and the second salt solution are contacted with one another under the conditions where the first salt and the second salt undergo the exothermic reaction.

Clause 9. The method of any one of clauses 1-8, wherein the first salt comprises an alkali metal nitrite and the second salt comprises an ammonium halide.

Clause 10. The method of any one of clauses 1-9, wherein first salt comprises sodium nitrite and the second salt comprises ammonium chloride.

Clause 11. The method of any one of clauses 1-10, wherein the decarbonated saline solution has a lower density than the carbonated aqueous fluid.

Clause 12. The method of any one of clauses 1-11, wherein the carbon dioxide promotes mobilization of hydrocarbons in the upper portion of the subterranean reservoir toward a production well, the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well, the method further comprising: producing at least a portion of each of the hydrocarbons from the production well.

Clause 13. A method comprising: introducing a carbonated aqueous fluid into a subterranean reservoir, the carbonated aqueous fluid comprising carbon dioxide dissolved in an aqueous fluid; introducing a first salt and a second salt into the subterranean reservoir; contacting the first salt with the second salt within the carbonated aqueous fluid in the subterranean reservoir under conditions where the first salt and the second salt undergo an exothermic reaction; heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; mobilizing hydrocarbons in the upper portion of the subterranean reservoir toward a production well with the carbon dioxide that migrates to the upper portion of the subterranean reservoir; wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

Clause 14. The method of clause 13, further comprising: introducing an aqueous flooding fluid into the subterranean reservoir prior to introducing the carbonated aqueous fluid, the carbonated aqueous fluid having a higher density than the aqueous flooding fluid.

Clause 15. The method of clause 13 or clause 14, wherein the decarbonated saline solution has a lower density than the carbonated aqueous fluid.

Clause 16. The method of any one of clauses 13-15, wherein the first salt is introduced to the subterranean reservoir in a first salt solution and the second salt is introduced to the subterranean reservoir in a second salt solution, the first salt solution and the second salt solution being kept separate from one another prior to contacting the first salt with the second salt within the carbonated aqueous fluid under the conditions where the first salt and the second salt undergo the exothermic reaction.

Clause 17. The method of any one of clauses 13-16, wherein the subterranean reservoir has a temperature sufficient to initiate the exothermic reaction, an acid is introduced to the subterranean reservoir to initiate the exothermic reaction, or any combination thereof.

Clause 18. The method of clause 17, wherein the acid is introduced to the subterranean reservoir in an aqueous solution containing one of the first salt or the second salt.

Clause 19. The method of any one of clauses 13-18, wherein the exothermic reaction occurs at a temperature of about 60° C. or greater, at a pH of about 5 or less, or any combination thereof.

Clause 20. The method of any one of clauses 13-19, wherein the first salt comprises a nitrite anion and the second salt comprises an ammonium cation, the nitrite anion and the ammonium cation undergoing the exothermic reaction once the first salt and the second salt are contacted with one another under the conditions where the first salt and the second salt undergo the exothermic reaction.

Clause 21. A method comprising: introducing a carbonated aqueous fluid into a subterranean reservoir, the carbonated aqueous fluid comprising carbon dioxide dissolved in an aqueous fluid; introducing a first salt solution comprising a first salt and a second salt solution comprising a second salt into the subterranean reservoir after introducing the carbonated aqueous fluid, the first salt comprising a nitrite anion and the second salt comprising an ammonium cation; contacting the first salt solution with the second salt solution in the subterranean reservoir under conditions where the nitrite anion of the first salt and the ammonium cation of the second salt undergo an exothermic reaction; and heating the carbonated aqueous fluid with heat produced via the exothermic reaction; wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released; wherein the decarbonated saline solution has a lower density than the carbonated aqueous fluid.

Clause 22. The method of clause 21, further comprising: mobilizing hydrocarbons in the upper portion of the subterranean reservoir toward a production well with the carbon dioxide that migrates to the upper portion of the subterranean reservoir; wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

Clause 23. The method of clause 21 or clause 22, wherein the subterranean reservoir has a temperature sufficient to initiate the exothermic reaction, an acid is introduced to the subterranean reservoir to initiate the exothermic reaction, or any combination thereof.

Clause 24. The method of clause 23, wherein the acid is introduced to the subterranean reservoir in the second salt solution.

Clause 25. The method of any one of clauses 21-24, wherein the exothermic reaction occurs at a temperature of about 60° C. or greater, at a pH of about 5 or less, or any combination thereof.

Clause 26. The method of any one of clauses 21-25, further comprising: introducing an aqueous flooding fluid into the subterranean reservoir prior to introducing the carbonated aqueous fluid, the carbonated aqueous fluid having a higher density than the aqueous flooding fluid and the decarbonated saline solution.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by one or more embodiments described herein. At the very least, and not as an attempt to limit the application of the doctrine of equivalents to the scope of the claim, each numerical parameter should at least be construed in light of the number of reported significant digits and by applying ordinary rounding techniques.

What is claimed is:

1. A method comprising:

introducing a carbonated aqueous fluid into a subterranean reservoir, the carbonated aqueous fluid comprising carbon dioxide dissolved in an aqueous fluid;

introducing an aqueous flooding fluid into the subterranean reservoir prior to introducing the carbonated aqueous fluid, the carbonated aqueous fluid having a higher density than the aqueous flooding fluid;

introducing a first salt solution comprising a first salt into the subterranean reservoir after introducing the carbonated aqueous fluid;

introducing a second salt solution comprising a second salt into the subterranean reservoir after introducing the carbonated aqueous fluid;

contacting the first salt and the second salt under conditions where the first salt and the second salt undergo an exothermic reaction; and heating the carbonated aqueous fluid with heat produced via the exothermic reaction;

wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released.

2. The method of claim 1, wherein the decarbonated saline solution has a lower density than the carbonated aqueous fluid and a higher density than the aqueous flooding fluid.

3. The method of claim 1, wherein the subterranean reservoir has a temperature sufficient to initiate the exothermic reaction, an acid is introduced to the subterranean reservoir to initiate the exothermic reaction, or any combination thereof.

4. The method of claim 3, wherein the acid is an organic acid.

5. The method of claim 3, wherein the acid is introduced to the subterranean reservoir in one of the first salt solution or the second salt solution.

6. The method of claim 1, wherein the exothermic reaction occurs at a temperature of about 60° C. or greater, at a pH of about 5 or less, or any combination thereof.

7. The method of claim 1, wherein the first salt comprises a nitrite anion and the second salt comprises an ammonium cation, the nitrite anion and the ammonium cation undergoing the exothermic reaction once the first salt and the second salt are contacted with one another under the conditions where the first salt and the second salt undergo the exothermic reaction.

8. The method of claim 1, wherein the first salt comprises an alkali metal nitrite and the second salt comprises an ammonium halide.

9. The method of claim 1, wherein first salt comprises sodium nitrite and the second salt comprises ammonium chloride.

10. The method of claim 1, wherein the decarbonated saline solution has a lower density than the carbonated aqueous fluid.

11. The method of claim 1, wherein the carbon dioxide promotes mobilization of hydrocarbons in the upper portion of the subterranean reservoir toward a production well, the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well, the method further comprising:

producing at least a portion of each of the hydrocarbons from the production well.

12. A method comprising:

introducing a carbonated aqueous fluid into a subterranean reservoir, the carbonated aqueous fluid comprising carbon dioxide dissolved in an aqueous fluid;

introducing an aqueous flooding fluid into the subterranean reservoir prior to introducing the carbonated aqueous fluid, the carbonated aqueous fluid having a higher density than the aqueous flooding fluid;

introducing a first salt into the subterranean reservoir;

introducing a second salt into the subterranean reservoir;

contacting the first salt with the second salt within the carbonated aqueous fluid in the subterranean reservoir under conditions where the first salt and the second salt undergo an exothermic reaction;

heating the carbonated aqueous fluid with heat produced via the exothermic reaction;

wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released;

mobilizing hydrocarbons in the upper portion of the subterranean reservoir toward a production well with the carbon dioxide that migrates to the upper portion of the subterranean reservoir;

wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

13. The method of claim 12, wherein the decarbonated saline solution has a lower density than the carbonated aqueous fluid.

14. The method of claim 12, wherein the first salt is introduced to the subterranean reservoir in a first salt solution and the second salt is introduced to the subterranean reservoir in a second salt solution, the first salt solution and the second salt solution being kept separate from one another prior to contacting the first salt with the second salt within the carbonated aqueous fluid under the conditions where the first salt and the second salt undergo the exothermic reaction.

15. The method of claim 12, wherein the subterranean reservoir has a temperature sufficient to initiate the exothermic reaction, an acid is introduced to the subterranean reservoir to initiate the exothermic reaction, or any combination thereof.

16. The method of claim 15, wherein the acid is introduced to the subterranean reservoir in an aqueous solution containing one of the first salt or the second salt.

17. The method of claim 12, wherein the exothermic reaction occurs at a temperature of 50° C. to 70° C., at a pH of about 5 or less, or any combination thereof.

18. The method of claim 12, wherein the first salt comprises a nitrite anion and the second salt comprises an ammonium cation, the nitrite anion and the ammonium cation undergoing the exothermic reaction once the first salt and the second salt are contacted with one another under the conditions where the first salt and the second salt undergo the exothermic reaction.

19. A method comprising:

introducing a carbonated aqueous fluid into a subterranean reservoir, the carbonated aqueous fluid comprising carbon dioxide dissolved in an aqueous fluid;

introducing a first salt solution comprising a first salt into the subterranean reservoir after introducing the carbonated aqueous fluid, the first salt comprising a nitrite anion;

introducing a second salt solution comprising a second salt into the subterranean reservoir after introducing the carbonated aqueous fluid, the second salt comprising an ammonium cation;

contacting the first salt with the second salt in the subterranean reservoir under conditions where the nitrite anion of the first salt and the ammonium cation of the second salt undergo an exothermic reaction;

heating the carbonated aqueous fluid with heat produced via the exothermic reaction;

wherein at least a portion of the carbon dioxide is released from the carbonated aqueous fluid upon heating and migrates from a lower portion to an upper portion of the subterranean reservoir, and a decarbonated saline solution is generated from the carbonated aqueous fluid from which the carbon dioxide is released;

wherein the decarbonated saline solution has a lower density than the carbonated aqueous fluid; and introducing an aqueous flooding fluid into the subterranean reservoir prior to introducing the carbonated aqueous fluid, the carbonated aqueous fluid having a higher density than the aqueous flooding fluid and the decarbonated saline solution.

20. The method of claim 19, further comprising:

mobilizing hydrocarbons in the upper portion of the subterranean reservoir toward a production well with the carbon dioxide that migrates to the upper portion of the subterranean reservoir;

wherein the decarbonated saline solution promotes mobilization of hydrocarbons in a middle portion of the subterranean reservoir toward the production well, and the carbonated aqueous fluid promotes mobilization of hydrocarbons in the lower portion of the subterranean reservoir toward the production well; and producing at least a portion of each of the hydrocarbons from the production well.

21. The method of claim 19, wherein the subterranean reservoir has a temperature sufficient to initiate the exothermic reaction, an acid is introduced to the subterranean reservoir to initiate the exothermic reaction, or any combination thereof.

22. The method of claim 21, wherein the acid is introduced to the subterranean reservoir in the second salt solution.

23. The method of claim 19, wherein the exothermic reaction occurs at a temperature of 50° C. to 70° C., at a pH of about 5 or less, or any combination thereof.

* * * * *